US006892514B2

(12) United States Patent
Kragh

(10) Patent No.: US 6,892,514 B2
(45) Date of Patent: May 17, 2005

(54) METHOD AND APPARATUS FOR WRAPPING PRINTED MATTERS

(75) Inventor: Ernst Dahl Kragh, Horsens (DK)

(73) Assignee: Schur Packaging Systems A/S, Horsens (DK)

( * ) Notice: Subject to any disclaimer, the term of this patent is extended or adjusted under 35 U.S.C. 154(b) by 0 days.

(21) Appl. No.: 10/480,845

(22) PCT Filed: Jul. 17, 2002

(86) PCT No.: PCT/DK02/00499

§ 371 (c)(1),
(2), (4) Date: Jan. 20, 2004

(87) PCT Pub. No.: WO03/008273

PCT Pub. Date: Jan. 30, 2003

(65) Prior Publication Data

US 2004/0159079 A1 Aug. 19, 2004

(30) Foreign Application Priority Data

Jul. 20, 2001 (DK) ..... 2001 01126

(51) Int. Cl.[7] ..... B65B 11/06
(52) U.S. Cl. ..... 53/466; 53/209; 53/228
(58) Field of Search ..... 53/461, 462, 463, 53/466, 209, 218, 226, 228; 493/418, 423, 450

(56) References Cited

U.S. PATENT DOCUMENTS

| | | | | | |
|---|---|---|---|---|---|
| 2,690,633 | A | * | 10/1954 | Denton | 53/463 |
| 2,906,069 | A | * | 9/1959 | Page et al. | 53/461 |
| 3,002,432 | A | | 10/1961 | Wendschuh | |
| 3,079,144 | A | | 2/1963 | Frei | |
| 3,222,844 | A | | 12/1965 | Smith et al. | |
| 3,855,758 | A | | 12/1974 | Walter et al. | |
| 4,047,478 | A | * | 9/1977 | Trostmann et al. | 99/450.1 |
| 4,060,227 | A | * | 11/1977 | Landgraf et al. | 493/418 |
| 4,071,997 | A | * | 2/1978 | Gunther et al. | 53/209 |
| 4,279,611 | A | | 7/1981 | Labombarde et al. | |
| 4,342,182 | A | | 8/1982 | Dennis et al. | |
| 4,430,844 | A | * | 2/1984 | James | 53/450 |
| 4,574,562 | A | | 3/1986 | Cavassa | |
| 4,622,802 | A | * | 11/1986 | Takamura | 53/466 |
| 4,678,173 | A | * | 7/1987 | Basinger et al. | 493/419 |
| 5,197,260 | A | * | 3/1993 | Chevalier et al. | 53/461 |
| 5,441,252 | A | * | 8/1995 | Hommes | 271/290 |

FOREIGN PATENT DOCUMENTS

| | | |
|---|---|---|
| DE | 543178 | 1/1932 |
| DE | 1586349 | 4/1971 |

* cited by examiner

*Primary Examiner*—Louis Huynh
(74) *Attorney, Agent, or Firm*—James Creighton Way; Meera P. Narasimhan

(57) ABSTRACT

The present invention relates to a method and an apparatus for wrapping bundles of printed matter by placing a folded film sheet around such bundles when these are conveyed to and through a wrapping station. The apparatus includes a lower, through-going belt conveyor with mutually separated conveyor straps and a couple of overhead band conveyors in line with each other creating a transverse gap between them. Below the spaces between the lower conveyor straps and just below the gap a transverse row of compressed air nozzles directed upwards is arranged.

8 Claims, 1 Drawing Sheet

METHOD AND APPARATUS FOR WRAPPING PRINTED MATTERS

This application claims the benefit of Danish Application No. PA 2001 01126 filed Jul. 20, 2001 and PCT/DK02/00499 filed Jul. 17, 2002.

BACKGROUND OF THE INVENTION

The present invention relates to a method and an apparatus for wrapping printed matter by placing a film sheet around the printed matter.

For wrapping printed matter or bundles of printed matter a folded film sheet is placed around such printed matter or bundles of printed matter when conveying these to and through a wrapping station.

The proposed task is very simple as the film sheet merely has to be folded once in order to cover the flat sides of the bundles of printed matter, primarily advertising print, moreover without being joined together around these bundles.

This problem is very easy to solve by a purely manual effort as long as there is plenty of time available, e.g. at low capacity whereas the problem becomes considerably more difficult when it has to be solved in connection with rapid conveyance. Many attempts have been made, but so far without any satisfactory result.

SUMMARY OF THE INVENTION

The invention has shown that it is still possible to solve the problem in a surprisingly simple and efficient way, also at very high capacities and by a continuous conveyance and wrapping of the printed matter.

According to the invention, this is achieved with a method which is peculiar in that the film sheet is placed on a first conveyor device, that the printed matter is placed partly on top of the film sheets such that a front part of the film sheet in the conveying direction is not covered by printed matter, that the film sheet with printed matter is introduced below a first height adjustable elevated belt, that at the end of the first elevated belt an upward air current is provided whereby the front part of the film sheet is blown up to a vertical position, that film sheets and printed matter are carried on below a second height adjustable elevated belt whereby the film sheet is folded back along the top side of the printed matter.

The method is carried out with a continuous conveying of the printed matter through the steps of wrapping.

The apparatus according to the invention is peculiar in that it includes a lower conveyor device, two height adjustable upper conveyor devices arranged in line with each other at a distance, one or more upwardly directed air nozzles arranged in a transverse gap between the two upper conveyor devices and below the lower conveyor device.

By this solution it is possible, in a simple and rapid way, to place the film sheet with a secure folding around the printed matter, irrespective of whether these are provided single or as a pile of printed matter. This is possible, even if the film does not have adjusted edges or other measures in advance in order to ease the folding such as may be the case with folding of cardboard items assisted by air.

According to a further embodiment, the apparatus is peculiar in that the lower conveyor device consists of a number of belts arranged side-by-side. This provides a safe support of printed matter in different sizes.

According to a further embodiment, the apparatus is particular in that the air nozzles are arranged in the spaces between the belts arranged side-by-side and below the surface of the lower conveyor device. Hereby, an air curtain may be created that appears largely uninterrupted and thereby enables a safe and sharp crease.

According to a further embodiment, the apparatus is peculiar in that a suction mouth piece is arranged above the gap between the two upper conveyor devices. Hereby, the air nozzles are assisted and the co-operation may increase the effect and thereby the speed for wrapping.

According to a further embodiment, the apparatus is peculiar in that the compressed air nozzles pulsate compressed air concurrently with the sheets being conveyed from the nozzles. Hereby the air is applied concentrated at the time of the continuous conveyance when air is needed for folding.

According to a further embodiment, the apparatus is peculiar in that means for sucking the film sheet down towards the conveyor device are provided before the placing of printed matter. Hereby good positioning of the sheet on the conveyor device is ensured. Thus, the sheet will be maintained even at high speeds and application of thin sheets.

According to a further embodiment, the apparatus is peculiar in that in a position above the gap between the two upper conveyor devices a stop meansis arranged, where the side edge of the film sheet is brought in contact. Hereby the place of folding is determined which is particularly advantageous by application of a thin and soft material where it is difficult to establish a well defined bending line. This is especially the case with small stacks or singly printed paper.

BRIEF DESCRIPTION OF THE DRAWINGS

The invention will hereafter be explained in more detail with reference to the drawing on which.

DETAILED DESCRIPTION OF THE PREFERRED EMBODIMENTS

The apparatus shown includes a lower through-going belt conveyor 2 with mutually separated conveyor straps 4 and a couple of overhead band conveyors 6 and 8 in line with each other forming a transverse gap 10 between them. Below the interspaces between the lower conveyor straps 4 and right below the gap 10, a transverse row of upwardly directed compressed air nozzles is arranged. These are preferably provided as flat nozzles in order to create an air curtain.

Figure 1:
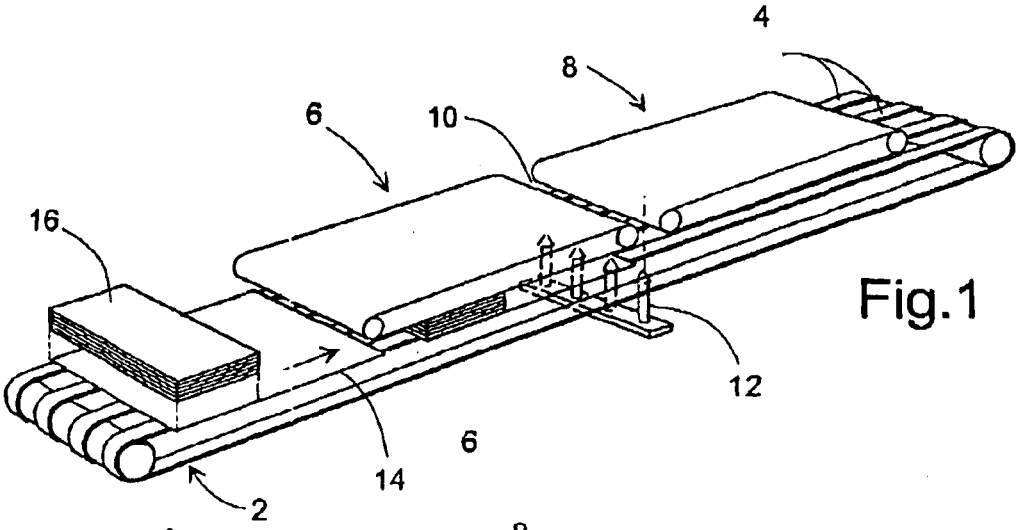
FIG. 1 shows a schematic view of an apparatus in perspective according to the invention.
Figure 2:
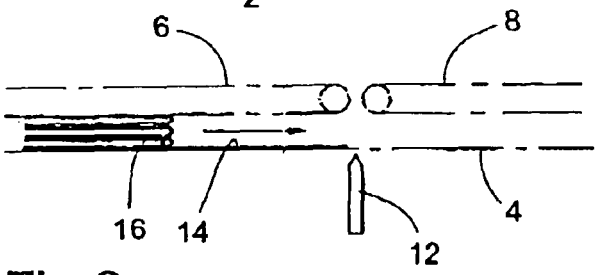
FIG. 2–5 show side views thereof for illustration of the mode of operation of the apparatus.

As outlined to the left side of FIGS. 1 and 2 it is provided that, in a suitable way, a sheet 14 of a wrapping film is placed successively on the upper course of the conveyor straps 4 which possibly may occur during participation of not shown means for inducing a sucking down of these sheets against the straps 4. Thereafter, the relevant blocks 16 of printed matter may be lead down from above such that these are placed at the rearmost part of the sheets 14.

Thereafter, the units 14, 16 run in below the elevated belt 6 and the nozzles 12 are filled with air cf. also FIG. 2.

Figure 3:
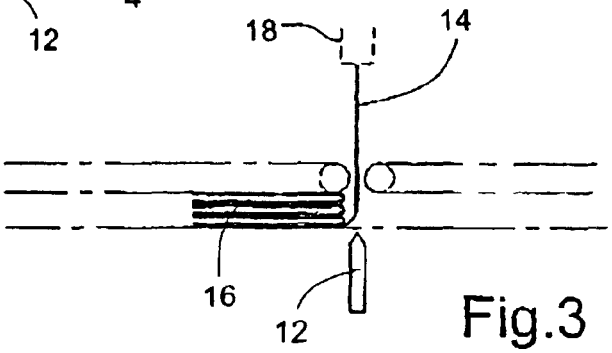

Thereby a curtain of air jets is created up through the upper gap 10 and when the front part of the sheet 14 reaches this area, this front part and thereafter the other front part 18 of the sheet will be blown up through the gap 10, see FIG. 3. At a position above the gap between the two upper conveyor devices, a stop means 18 is indicated that is arranged preferably height adjustable on a guide (not shown).

Figure 4:
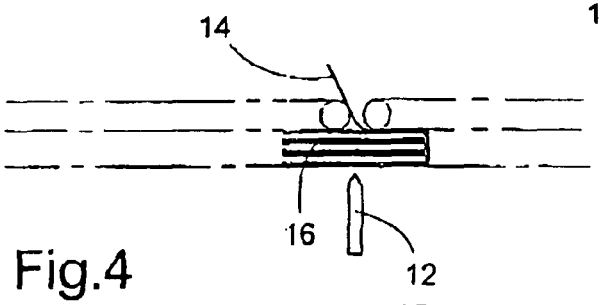

During the further conveyance, the protruding sheet section will be forced in below the succeeding elevated belt cf. FIG. 4 such that the sheet section 18 is now rolled on to the top side of the block 16 of printed matter.

Figure 5:
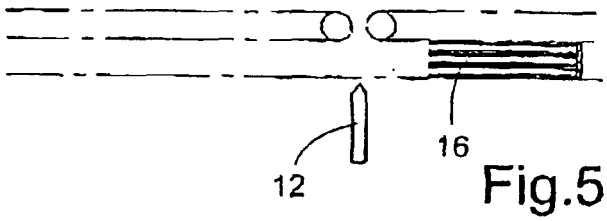

Hereafter, the ready-wrapped item 14,16 can be lead out for delivery, FIG. 5.

Naturally, it is critical that the free end of the sheet 18 is really blown up through the gap 10 during conveying with high speed, and it may possibly be necessary to adjust the direction and location of the nozzles 12 depending on the character of the sheets 14. Through tests have only shown that it is actually possible to work with high speed as well as high operational safety in the simple way stated.

A suction mouth piece may possibly assist above the gap 10.

What is claimed is:

1. Method for wrapping printed matter by placing film sheet around the printed matter, comprising the steps of:

placing a film sheet on a first conveyor device;

placing a printed matter partly on top of the film sheet such that a front part of the film sheet in the conveying direction is not covered by the printed matter;

conveying the film sheet with the printed matter below a first height adjustable elevated belt;

blowing upwardly the front part of the film sheet to a vertical position with an upward air current provided at an end of the first height adjustable elevated belt; and continuously conveying the film sheet and the printed matter below a second height adjustable elevated belt such that the front part of the film sheet is folded along top side of the printed matter.

2. Apparatus for wrapping printed matter by placing a folded film sheet around the printed matter, comprising:

a lower conveyor device for conveying a film sheet placed thereon;

two height adjustable upper conveyor devices arranged in line with each other at a distance and directly above the lower conveyor device; and one or more upwardly directed air nozzles arranged in a transverse gap between the two upper conveyor devices and below the lower conveyor device.

3. Apparatus according to claim 2, wherein the lower conveyor device consists of a number of belts arranged side-by-side.

4. Apparatus according to claim 3, wherein the air nozzles are arranged in the spaces between the belts arranged side-by-side and below the surface of the lower conveyor device.

5. Apparatus according to claim 2, wherein a suction mouth piece is arranged above the gap between the two upper conveyor devices.

6. Apparatus according to claim 2, wherein the air nozzles pulsate compressed air concurrently with the sheets being conveyed from the nozzles.

7. Apparatus according to claim 2, wherein means for sucking the film sheet down towards the surface of the lower conveyor device are provided upstream of the transverse gap between the upper conveyor devices.

8. Apparatus according to claim 2, wherein in a position above the gap between the two upper conveyor devices a stop means is arranged where the lateral edge of the film sheet is brought in contact.

* * * * *